United States Patent [19]

Bähre et al.

[11] 4,203,557

[45] May 20, 1980

[54] CONTINUOUS-OPERATION CRUSHING MACHINE

[75] Inventors: Karl Bähre, Gladbeck; Reinhold Krohm, Herne, both of Fed. Rep. of Germany

[73] Assignee: Klökner-Werke Aktiengesellschaft, Duisburg, Fed. Rep. of Germany

[21] Appl. No.: 941,137

[22] Filed: Sep. 11, 1978

[30] Foreign Application Priority Data

Sep. 13, 1977 [DE] Fed. Rep. of Germany ..... 2741127

[51] Int. Cl.[2] ..... B02C 13/09

[52] U.S. Cl. ..... 241/186 R; 241/189 R; 241/191

[58] Field of Search ..... 241/186 R, 186.2, 189 R, 241/189 A, 191, 195, 285 R, 287

[56] References Cited

U.S. PATENT DOCUMENTS 4,047,673 9/1977 Aulmann et al. ..... 241/189 R X

*Primary Examiner*—Mark Rosenbaum

*Attorney, Agent, or Firm*—Michael J. Striker

[57] ABSTRACT

A crushing-machine housing accommodates a rotating crushing roller whose periphery travels in the same direction as the conveyor which feeds material through the crushing machine, the clearance between the crushing roller and such conveyor determining the maximum volumetric rate at which material can be fed through the machine. The crushing roller is of crankshaft-like configuration, having a crank pin carrying crushing implements located far from the crushing-roller rotation axis, to either side of the crank pin a respective crank web whose center of gravity is eccentric with respect to the crushing-roller rotation axis, and to either side of the crank webs a respective crank journal rotatably mounted on the machine housing. The crank webs of the crankshaft-like crushing roller carry crushing implements located on the side of the roller rotation axis diametrally opposite to the crank-pin tool-carrying part of the crushing roller. When the volumetric throughput of goods is to be changed, there is no need to stop the machine and raise its housing to create a greater clearance between the crushing roller and the conveyor, as in prior art.

6 Claims, 2 Drawing Figures

10
13
12
27
29
25
II
II
22
23
21

CONTINUOUS-OPERATION CRUSHING MACHINE

BACKGROUND OF THE INVENTION

The present invention concerns continuous-operation crushing machines of the type used to reduce the size of large pieces of material, most typically coal and sometimes pieces of rock contained in the chunks of coal. Conventionally, the crushing machine comprises a crushing roller which is rotated such that its periphery travels in the same direction as the conveyor which transport the material through the crushing machine. Typically, the crushing roller is mounted above the guide trough of the conveyor, spaced from the conveyor a certain distance so as to leave room into which the material to be crushed can enter.

Conventionally, such a crushing machine has a throughgoing shaft, the axial ends of which are journalled on the housing of the machine. The crushing roller is mounted on the shaft and is fitted with crushing implements. Because such mounting shaft is surrounded by the crushing roller, the distance between the crushing roller and the bottom of the conveying trough determines the maximum height of the endless body of material which can be fed through the crushing machine. If it is desired to increase this distance, to permit the machine to process a greater amount of material per unit time, then this requires that the crushing roller be raised, which in turn requires that the crushing-machine housing be lifted to a height greater than would otherwise be necessary.

SUMMARY OF THE INVENTION

It is the general object of the invention to provide a crushing machine of the type in question, but not exhibiting the disadvantage just referred to. In particular, the machine is to be capable of handling the peak material-amount delivery rates occurring during high-efficiency material processing, while being maintained at a constant throughput setting, i.e., so that when the amount of material fed to the machine per unit time increases markedly, it is not necessary to stop the machine and readjust it, e.g., increase the height of the crushing-roller housing as in the prior art.

This object is achieved, in acccordance with the present invention, by providing a crushing roller which has the general configuration of a crankshaft. The crank pin of the crankshaft serves as a tool carrier. Two crank webs are provided, located to opposite axial sides of the crank pin, and these are mounted for rotation in the machine housing at the crank journals at the two axial ends of the crankshaft-like crushing roller.

This construction results in a continuous-operation crushing machine which meets the object in question. Additionally, when crushing material having a size suitable for belt or screw conveying, if the throughput of the machine is a given then the inventive construction exhibits lower power consumption, or conversely if the power consumption is a given a higher throughput becomes possible, i.e., relative to comparable prior-art constructions. Height adjustments, of the type needed in the prior art to accomodate increased throughput of material, and which can increase the total height of the machine to a degree limiting its possibilities for use, are no longer necessary. Furthermore, the frequency of the fundamental periodic movement of the crushing roller can be reduced, by reducing the rotary speed of the crushing roller, but maintaining sufficient rotary energy. Additionally, surge-like emissions of dust are largely precluded, due to the pressure equalization which inherently occurs within the crushing space in the machine housing.

According to a further concept of the invention, the crank webs located to either side of the crank-pin tool carrier are configured for eccentric rotation, in order to equalize the mass of the crushing roller, and they are provided with crushing implements located diametrally opposite to the crank-pin tool carrier.

The crushing roller can also be designed to have cylindrically shaped crank webs, e.g., for the sake of simpler production. Then, in order to achieve the equivalent of the eccentric rotation referred to earlier, i.e., to achieve mass equalization, the material of the crank webs can incorporate bodies of material whose specific weight is different from that of the material of the remainder of the crank webs.

Advantageously, the center of gravity of the crank-pin tool carrier is located a marked distance from the rotation axis of the crankshaft-like crushing roller. Such center of gravity can readily be made to have a distance corresponding to the radius of the orbit through which the crank-pin tool carrier moves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
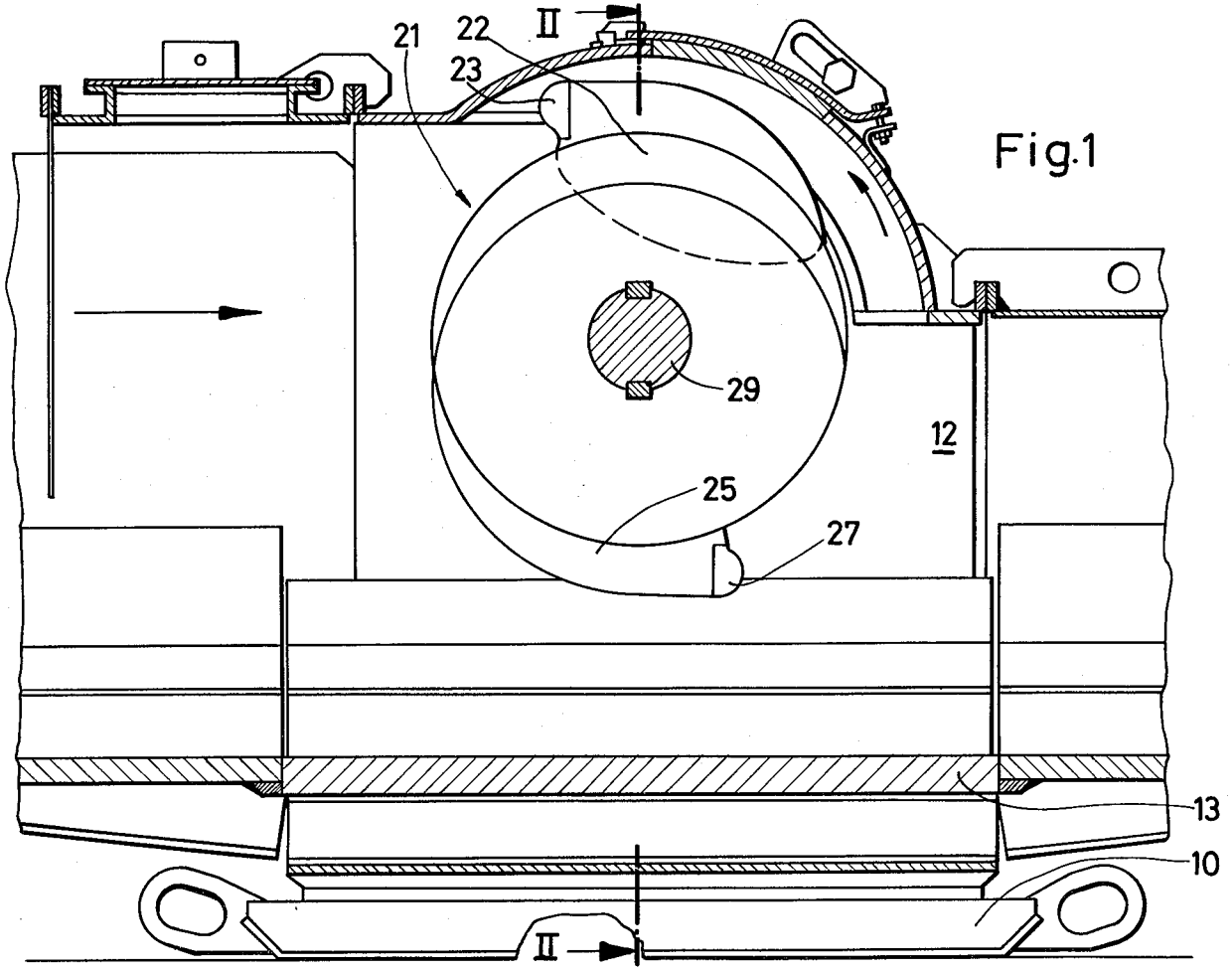
FIG. 1 is a section taken along line I—I of FIG. 2.
Figure 2:
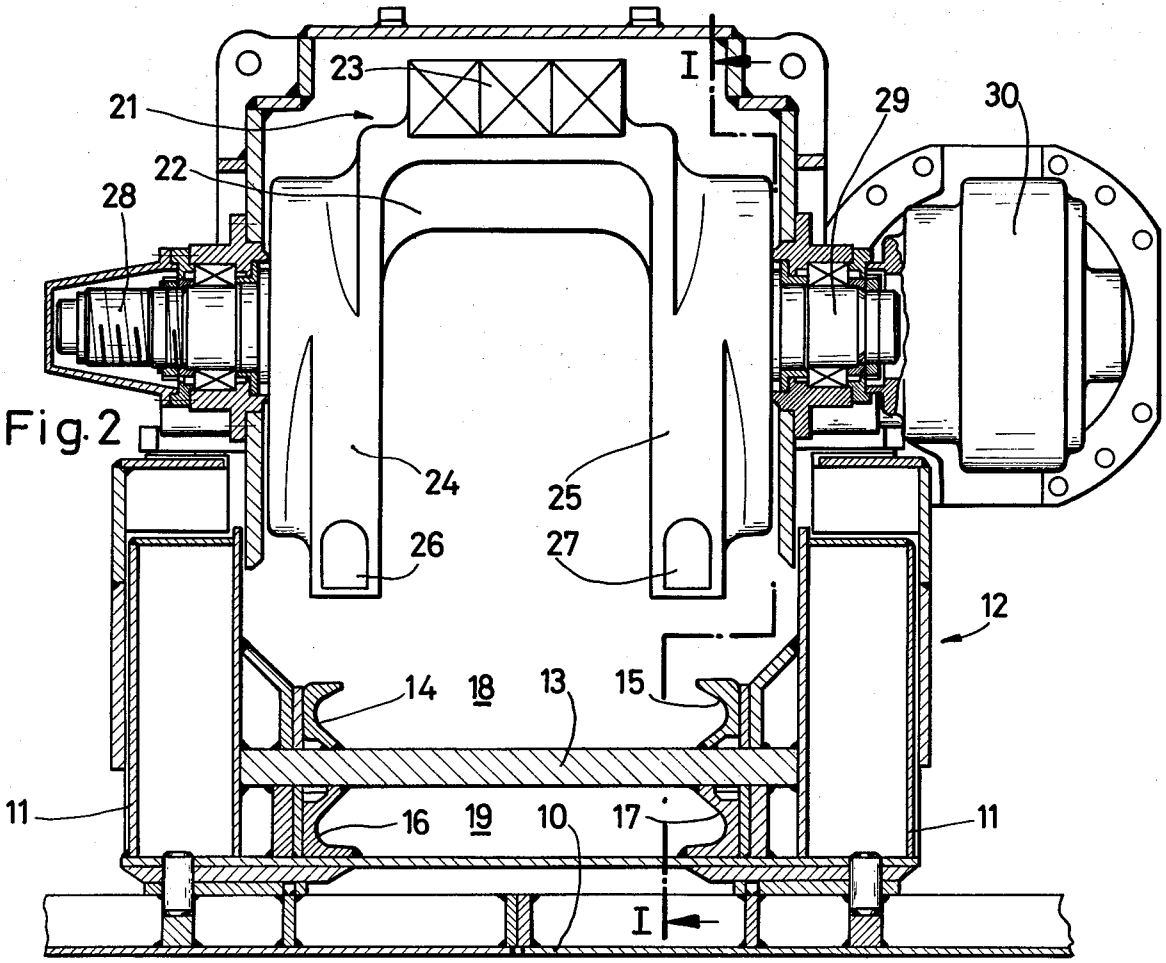
FIG. 2 is a section taken along line II—II of FIG. 2, both Figures illustrating a preferred exemplary embodiment of the invention.

The continuous-operation crushing machine shown in FIGS. 1 and 2 serves to crush large-chunk and flat mineral material, such as pieces of coal, such pieces of coal perhaps also containing pieces of rock. Numeral 10 denotes the base of the machine, 11 its lower framework, and 12 its main housing. Mounted in the lower framework 11 is the base plate 13 of the trough conveyor which transports material through the machine. Trough-conveyor base plate 13 is of thick construction, to withstand the crushing force applied to it by the crushing roller of the machine. The trough-conveyor base plate 13 and the side profile members 14, 15, 16, 17 define the upper-run space 18 and the return-run space 19 through which the (non-illustrated) drag-chain conveyor of the trough conveyor travels.

Rotatably mounted in the crushing-machine housing 12 is the machine's crushing roller 21. The crushing roller 21 is of crankshaft-like configuration. Crushing roller 21, intermediate its axial ends, comprises a tool carrier 22 corresponding to the crank pin of a crankshaft and carrying crushing implements 23. Located to either axial side of crank-pin-like tool carrier 23 are parts 24, 25 corresponding to the crank webs of a crankshaft, and these carry crushing implements 26 and 27. For the sake of mass balance, the center of gravity of each crank web 24, 25 is located eccentrically relative to the rotation axis of the crushing roller 21. To accomplish this, the material of the crankshaft-like crushing roller 21, and in particular of its webs 24, 25, can incorporate one or more bodies of lead.

The crank webs 24, 25 carry the crank journals 28, 29 which are rotatably supported by the crushing-machine housing 12 and driven by a drive motor 30.

As an alternative to achieving mass balance by incorporation of lead bodies, or in addition thereto, the crushing roller can be provided with one or plural mass-balancing counterweights located at least partly out of the path of travel of the goods being crushed, for example located outside the crushing-machine housing 12 but rotating along with the crankshaft-like crushing roller 21.

It will be understood that each of the elements described above, or two or more together, may also find a useful application in other types of constructions differing from the types described above.

While the invention has been illustrated and described as embodied in a coal-crushing machine of particular type it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A crushing machine, particularly for the crushing of pieces of coal which may contain pieces of rock, the machine comprising, in combination, a conveyor guide structure for guiding transported material to be crushed through the machine; a machine housing mounted above the conveyor guide structure; a crushing roller mounted for rotation in the machine housing about a rotation axis and drive means rotating the crushing roller in the direction in which material to be crushed is transported through the machine, the material to be crushed passing through the space intermediate the conveyor guide structure and the crushing roller, the crushing roller having the general configuration of a crankshaft including a central crank pin, two crank webs located to respective axial sides of the central crank pin, and two crank journals each extending from a respective crank web, the crank journals being rotatably supported by the machine housing, and furthermore including crushing implements supported on the crank pin, the crank pin serving as a crushing tool carrier, the space axially intermediate the crank webs being an empty space devoid of crushing roller structure beginning at least in the vicinity of the rotation axis and proceeding all the way radially outwards in the direction away from the crank pin, whereby the empty space permits the passage through the machine housing of large pieces or amounts of coal.

2. A crushing machine as defined in claim 1, the radially innermost part of the crank pin being radially spaced from the rotation axis, the space axially intermediate the crank webs being an empty space beginning at the radially innermost part of the crank pin and proceeding radially inwards towards the rotation axis and continuing from the rotation axis all the way radially outwards in the direction away from the crank pin, whereby the rotation axis extends in empty space intermediate the crank webs.

3. The crushing machine defined in claim 1, the center of gravity of the crank pin being located remote from the rotation-axis of the crankshaft-like crushing roller by a distance approximately corresponding to the radius of the orbit along which the crushing implements on the crank pin move.

4. A crushing machine, particularly for the crushing of pieces of coal which may contain pieces of rock, the machine comprising, in combination, a conveyor guide structure for guiding transported material to be crushed through the machine; a machine housing mounted above the conveyor guide structure; a crushing roller mounted for rotation in the machine housing and drive means rotating the crushing roller in the direction in which material to be crushed is transported through the machine, the material to be crushed passing through the space intermediate the conveyor guide structure and the crushing roller, the crushing roller having the general configuration of a crankshaft including a central crank pin, two crank webs located to respective axial sides of the central crank pin, and two crank journals each extending from a respective crank web, the crank journals being rotatably supported by the machine housing, and furthermore including crushing implements supported on the crank pin, the crank pin serving as a crushing tool carrier, the two crank webs each being configured such as to eccentrically rotate about the rotation axis of the crankshaft-like crushing roller, and furthermore including crushing implements mounted on the crank webs at locations which are on the side of the crushing-roller rotation axis diametrally opposite to the crank pin.

5. The crushing machine defined in claim 4, the crank webs being of generally cylindrical shape and in order to balance the mass of the crankshaft-like crushing roller incorporating bodies of material differing in specific weight from the remainder of the crushing roller.

6. A crushing machine, particularly for the crushing of pieces of coal which may contain pieces of rock, the machine comprising, in combination, a conveyor guide structure for guiding transported material to be crushed through the machine; a machine housing mounted above the conveyor guide structure; a crushing roller mounted for rotation in the machine housing and drive means rotating the crushing roller in the direction in which material to be crushed is transported through the machine, the material to be crushed passing through the space intermediate the conveyor guide structure and the crushing roller, the crushing roller having the general configuration of a crankshaft including a central crank pin, two crank webs located to respective axial sides of the central crank pin, and two crank journals each extending from a respective crank web, the crank journals being rotatably supported by the machine housing, and furthermore including crushing implements supported on the crank pin, the crank pin serving as a crushing tool carrier, the crank webs being of generally cylindrical shape and in order to balance the mass of the crankshaft-like crushing roller incorporating bodies of material differing in specific weight from the remainder of the crushing roller.

* * * * *